United States Patent [19]

McKnight et al.

[11] 4,144,970

[45] Mar. 20, 1979

[54] INSPECTION APPARATUS FOR FILLED CAPSULE

[75] Inventors: Hugh P. McKnight; Van B. Hostetler, both of Indianapolis, Ind.

[73] Assignee: Eli Lilly and Company, Indianapolis, Ind.

[21] Appl. No.: 823,296

[22] Filed: Aug. 10, 1977

[51] Int. Cl.[2] ..... B07C 5/16; B07C 5/02

[52] U.S. Cl. ..... 209/542; 209/589; 209/905; 209/914

[58] Field of Search ..... 209/73, 111.5, 540, 209/542, 589, 905, 914; 198/392, 480, 608, 803

[56] References Cited

U.S. PATENT DOCUMENTS

| | | | |
|---|---|---|---|
| 2,567,033 | 9/1951 | Schutz | 198/480 X |
| 2,622,733 | 12/1952 | Pipkin et al. | 209/73 |
| 3,042,183 | 7/1962 | Ackley | 198/392 |
| 3,348,049 | 10/1967 | Stacey | 209/111.7 T X |
| 3,817,423 | 6/1974 | McKnight | 221/173 |
| 3,969,227 | 7/1976 | Garris | 209/73 |

*Primary Examiner*—Joseph J. Rolla

*Attorney, Agent, or Firm*—Houston L. Swenson; Arthur R. Whale

[57] ABSTRACT

A rotary capsule receiving platform is provided having a plurality of vertical hollow receiving tubes, with means for positioning each tube beneath a filled capsule supply hopper for receiving a capsule in an upright position. A plurality of retaining sleeves closely envelop the tubes and extend beyond the free ends of the tubes in a first position for receiving the filled capsule and upon advancing to an X-ray emitting and measuring unit are lowered into a second position to fully expose the filled capsule.

4 Claims, 3 Drawing Figures

INSPECTION APPARATUS FOR FILLED CAPSULE

BACKGROUND OF THE INVENTION

Until recently technology for measuring the filled contents of articles such as pharmaceutical capsules and cartridges containing gun powder has been directed primarily toward weighing the filled item to determine if it has received an overload of contents or an underload. Although this type of measuring system has been found to be generally adequate for most purposes a new technology has developed which promises a far more accurate and faster measuring system. This new technology utilizes an X-ray cathode tube for emitting a minute amount of radiation into the filled item that is being examined. The amount of radiation necessary to effectively measure the contents of the articles such as pharmaceutical capsules is determined depending upon the type and size of the capsule and its contents. The emitted radiation is absorbed by the contents of the capsule and consequently this amount of absorption provides a means for measuring the quantity of the material in the capsule. The Bedford Engineering Company, of Bedford, Massachusetts, offers a system for electronically measuring the amount of material within a capsule through such a radiation technique. This electronic system has a sensing device which measures the amount of radiation scattered by the radiation exposed capsule and depending upon whether or not the quantity therein is high, low or within the acceptable range for the capsule, actuates one of three devices for either rejecting the capsules on the basis of their high or low quantity or ejects them into an acceptable container.

The electronics system of this unit is such that it can handle as many as 10 to 60 thousand units per hour if a means is provided for accurately transfering the capsules past the measuring device at such a high speed. Thus, it is an object of this invention to provide a capsule transfer apparatus that will quickly pass filled capsules across the electronic sensing unit in an accurate and controlled fashion to provide controlled measurement of their contents. In addition, the transfer apparatus is capable of repeatedly carrying a sample specimen by the electronic sensing unit for the constant recalibration of the unit.

SUMMARY OF THE INVENTION

A capsule supply unit provides a steady stream of filled capsules onto a plurality of upright tubes that are mounted on a rotary transfer platform. The capsules come to rest on the free ends of these tubes and are maintained in an upright position by means of a vacuum that gently seats them on the ends of the tubes. Each tube has a sleeve mounted on it for receiving the capsule thereon and to align and maintain the capsules in a perfectly upright position as they are being rapidly transported by the rotary platform. The centrifugal force on the capsules as they are trans ported might otherwise cause them to become slightly out of alignment. However in order to emit radiation and sense the amount of radiation absorbed by the capsules it is necessary to fully expose them as they pass the measuring unit. This is accomplished by providing a means for bringing each sleeve downward into a second position after the capsule has been secured by vacuum to fully expose the capsule as it passes the measuring unit. One of the transfer tubes may be designed to not carry a capsule and instead be of suitable dimension to act as a sample for testing and subsequent recalibration of the sensing unit.

DESCRIPTION OF THE PREFERRED EMBODIMENT

Figure 1:
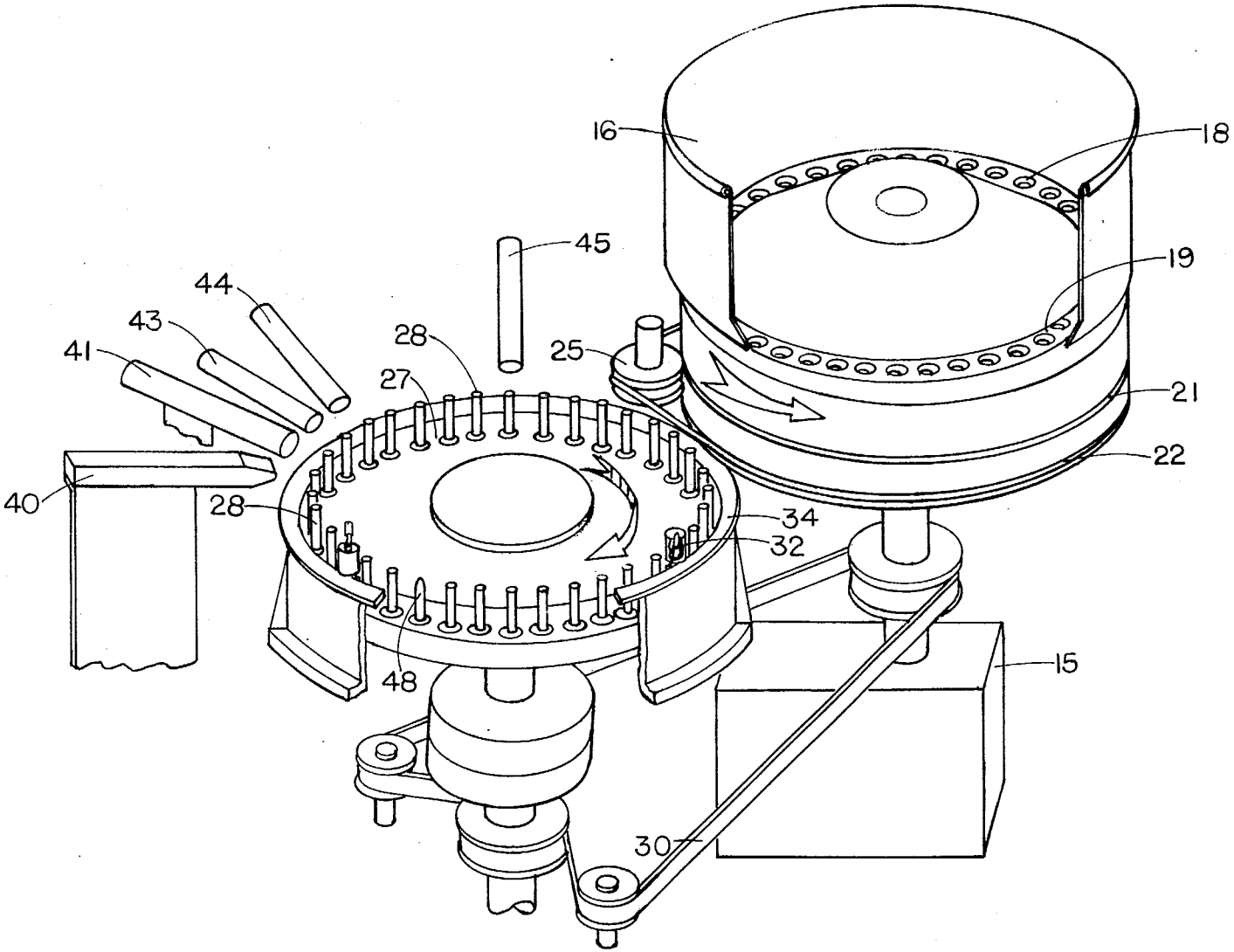
FIG. 1 is a perspective view of the transfer mechanism of this invention and includes a schematic showing of the X-ray measuring unit.
Figure 2:
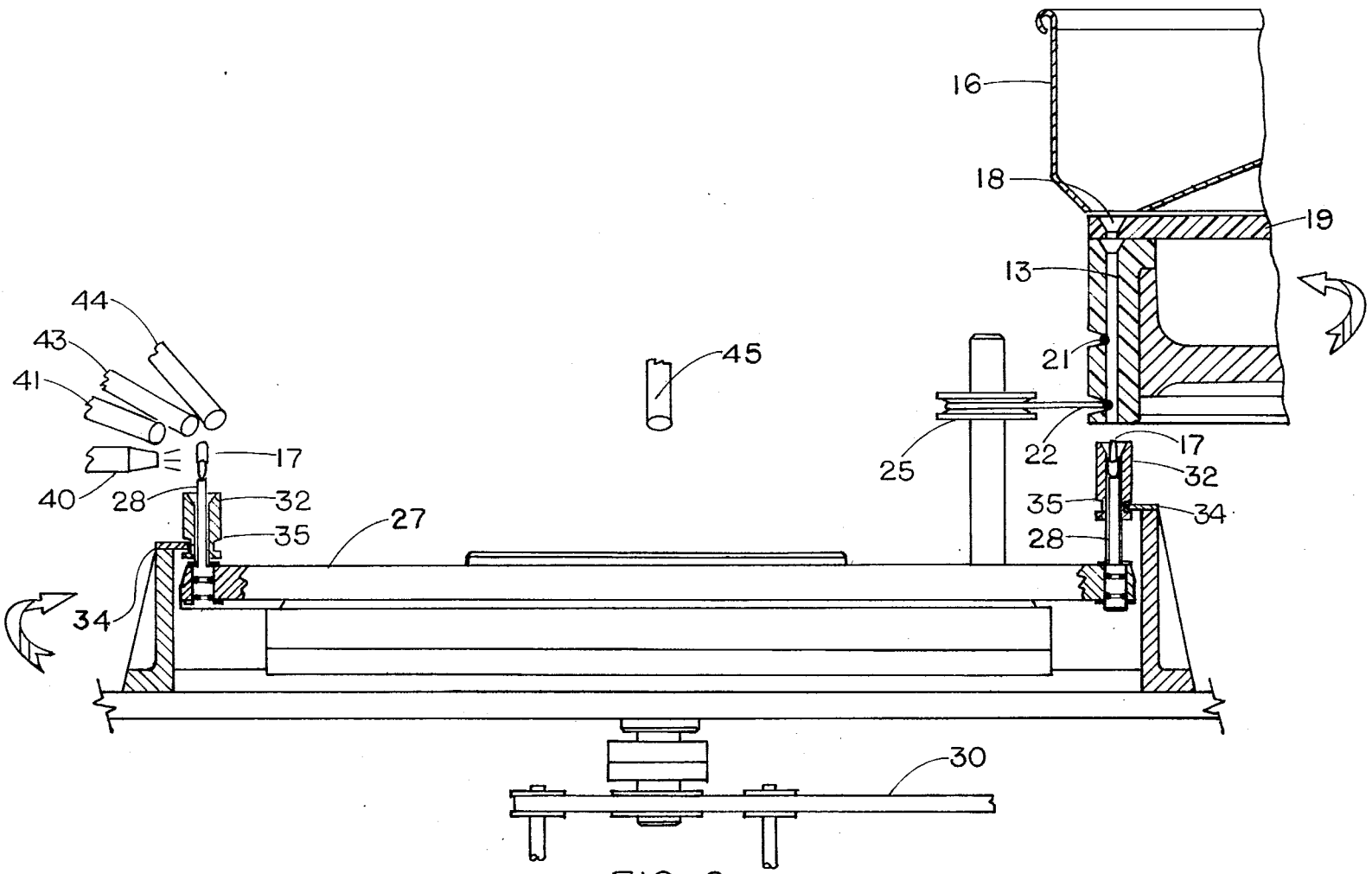
FIG. 2 is a cross section of the transfer mechanism.

Referring to the drawing and in particular to FIGS. 1 and 2, an apparatus is partially illustrated which embodies our invention. A plurality of vertical capsule receiving chambers 13 are arranged in a circular pattern and connected to a rotary power drive 15. A capsule hopper 16 is partially illustrated for delivering filled capsules 17 into the chambers 13 through openings 18 which are formed in a rotary plate 19. Our invention is not limited to this particular capsule delivering arrangement for which a full disclosure can be found in U.S. Pat. No. 3,817,423. Similar to the delivery system in that patent, first and second belts 21 and 22 cooperate with the chambers 13 to control the delivery of the capsules.

Each chamber 13 (FIG. 2) is long enough to carry several capsules in it and consequently as belt 22 releases the capsules it is necessary to be certain that the capsule above it is retained, a function provided by belt 21. Belt 22 is supported in part on a stationary pulley 25 which causes the ring to ride out of contact with chambers 13 at a selected point. Likewise, a second pulley which is not illustrated in the drawings is used to space belt 21 from chambers 13 at a different selected point in order to release a capsule down into the lower most position of chamber 13.

A rotatable transfer platform 27 is illustrated in FIGS. 1 and 2 and contains a plurality of capsule receiving tubes 28 arranged in a circular pattern. In the illustrated embodiment this transfer platform rotates in synchronization with the rotation of the capsule chambers 13 and this is accomplished by a simple drive belt 30. It is apparent that the diameter of the capsule chamber unit need not be identical with the diameter of the transfer platform 27. The primary goal is to achieve exact alignment of a capsule receiving tube 28 with a respective capsule chamber 13. Each tube is hollow and is encompassed by an alignment and retaining sleeve 32 that is slidably positioned thereon. The inside diameter of each retaining sleeve 32 is slightly greater than the outside diameter of its respective tube 28 which in turn approximates the diameter of the capsules that are being handled. A stationary camtrack 34 is provided about the entire circumference of the transfer platform. Track 34 is engaged with a shoulder 35 of each retaining sleeve.

The particular type of inspection system used in conjunction with my invention may vary depending upon the type of inspection performed on the capsules. Thus, in the illustrated embodiment, the inspection system is designed to determine the accuracy of the filled contents of each capsule. However it is to be understood that my invention is adaptable to other systems that are designed for inspecting the quality of the capsules themselves, cartridges and other small articles. Thus an X-ray inspection system is shown which has an X-ray emitting tube 40. This tube subjects each capsule to a controlled pulsed amount of radiation. A radiation sensor 41 is positioned to read the amount of radiation absorbed by each capsule. This sensor 41 detects the minute amount of radiation that is stopped by each filled capsule and through an electrical circut, actuates a mechanism for ejecting the capsule into a designated hopper.

Thus, a receiving tube 43 is positioned for receiving capsules which are determined to be low in their filled weight. This ejection can occur by means of a stationary jet of air that is actuated to force the capsule off its pin into the receiving tube 43. A second tube 44 is provided for receiving capsules which are determined to have too much powder in them and a third receiving tube 45 is positioned for receiving capsules that are properly filled. The electrical impulses provided for actuating the jet air which blows a capsule off of its pin is all part of a system that can be obtained with the X-ray radiation and detection device. This system is presently available from the Bedford Engineering Manufacturing Company of Bedford, Massachusetts and is not to be considered a part of our invention. Solenoids are actuated by the electrical impulses which are responsive to radiation sensor 41 to open and close the air lines for ejecting the capsules.

In operation, filled capsules are placed in hopper 16 which is rotating and vibrating to displace capsules into opening 18. When space becomes available in capsule chambers 13, capsules drop from openings 18 into the chambers. As previously described, belts 21 and 22 cooperate to maintain a steady supply and release of filled capsules from chambers 13.

Figure 3:
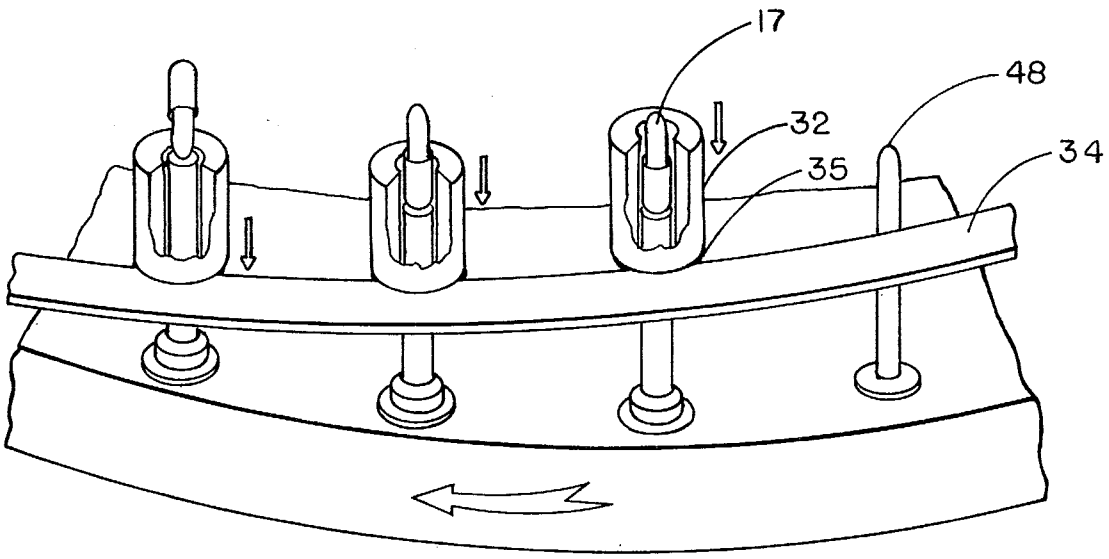
FIG. 3 is a partial view in perspective illustrating the capsule retainer sleeves in their different positions.

Referring to FIG. 3, retaining sleeve 32 is elevated by camtrack 34 in one position and lowered in a second position in order to discharge capsules. Thus, as a pin is passed beneath a capsule chamber 13 which is in the process of releasing a capsule the retaining sleeve 32 is in its upper position. A capsule is then dropped into the sleeve and assumes an alligned or upright position securely on the pin as it rotates about the axis of the transfer platform. A continuous vacuum is supplied to each of the hollow pins in a conventional manner until the capsule that is held by the vacuum is ready to be discharged. However, this vacuum may not be sufficient to maintain a capsule in a perfectly upright position. Consequently, retaining sleeves 32 which serve to initially align the capsules also serve to maintain the capsules in an upright position until they are secured in position by vacuum as they approach the inspection station. Otherwise, the centrifugal force applied to each capsule as the transfer platform rotates might cause the capsule to lean outwardly. This in turn subjects the capsules to a varying amount of radiation and will adversely affect the inspection results.

Camtrack 34 is designed to maintain the sleeve in a substantially upper position whereby the capsule therein will not be able to tilt outwardly until just prior to being exposed to the radiation from the X-ray emitter 40. At this point the capsule is fully exposed since the retaining sleeve is in its lower most position. The sleeve stays in its lower most position as the capsule passes by the X-ray sensing device 41 and the final capsule receiving tube 45.

FIGS. 1 and 3 illustrate a solid pin 48 which is not designed to receive a capsule. This pin is dimensioned to serve as a test sample for the purpose of recalibration of the radiation sensing unit. Although the electronic components of this unit are fairly stable, a small amount of drifting can be expected. Thus, pin 48 is designed to absorb and scatter an amount of radiation equal to a capsule that contains a known quantity of powder. The radiation scattered by pin 48 serves as a zero reference point for the sensing unit. This test pin, as it passes the X-ray sensing device 41 can be used to activate an alarm if the electronic components have drifted. Instead of an alarm an electronic calibration circuit can be activated to readjust the sensing unit. It should be noted that the use of a rotary transport system enables one to check the accuracy of the sensing unit on a cyclical basis through the use of only one sample specimen 48. If the capsule conveyor system was not of an endless type it would be necessary to feed in numerous test specimens during the operation of the unit.

We claim:

1. In an apparatus for inspecting the fill content quantity of pharmaceutical capsules in which capsules are individually passed by an inspection station and an ejection station, the improvement of a capsule transfer mechanism comprising: a plurality of vertical chambers for receiving capsules, said chambers being arranged in a circular pattern and connected to a rotary power drive, a rotatable transfer platform having a plurality of vertical hollow receiving tubes connected to a vacuum means, each of said tubes being in axial alignment beneath a respective one of said vertical chambers for at least a part of its rotary cycle, means for regulating the delivery of said capsules onto the free ends of said tubes in an upright position and a plurality of retaining sleeves closely enveloping respective tubes and extending beyond the free ends of said tubes in a first position for receiving said capsules, each of said sleeves having a circumferential shoulder that rests on a stationary camtrack positioned about said transfer platform for lowering said sleeves into a second position to fully expose said filled capsules as they are transported on said tubes by the inspection and ejection stations.

2. The improvement of claim 1 in which said ejection station comprises three capsule receptacles which receive the capsules according to their rejected or accepted categories.

3. The improvement of claim 2 in which a vacuum means connected to each of said hollow tubes is interrupted at said ejection station.

4. The improvement of claim 3 in which said transfer platform has a pin disposed among said hollow tubes to simulate a capsule having an accurate powder fill.

* * * * *